United States Patent [19]

Köstermeier

[11] 4,355,673

[45] Oct. 26, 1982

[54] CUTTER FOR WOOD CHIPPERS

[76] Inventor: Karl-Heinz Köstermeier, Eckelsheimerstr. 18, 6556 Wöllstein, Fed. Rep. of Germany

[21] Appl. No.: 215,273

[22] Filed: Dec. 11, 1980

[30] Foreign Application Priority Data

Dec. 14, 1979 [DE] Fed. Rep. of Germany ..... 2950494
Oct. 22, 1980 [DE] Fed. Rep. of Germany ..... 3039833

[51] Int. Cl.[3] ..... B27G 13/00

[52] U.S. Cl. ..... 144/230; 144/241; 407/120

[58] Field of Search ..... 144/39, 41, 42, 162 R, 144/172, 174, 176, 218, 230, 241; 407/120

[56] References Cited

U.S. PATENT DOCUMENTS

| | | | |
|---|---|---|---|
| 2,449,605 | 9/1948 | Kelton | 144/41 |
| 2,710,635 | 6/1955 | Alexander | 144/230 |
| 2,825,371 | 3/1958 | Forman | 144/41 |
| 3,017,912 | 1/1962 | Sybertz et al. | 144/42 |
| 4,260,002 | 4/1981 | Schmalz et al. | 144/230 |

*Primary Examiner*—W. D. Bray
*Attorney, Agent, or Firm*—Harness, Dickey & Pierce

[57] ABSTRACT

The disclosure relates to wood chippers having a chip separation surface comprising unitary ribs which, after grinding of the cutter, form chip separator tips.

6 Claims, 10 Drawing Figures

FIG. 1
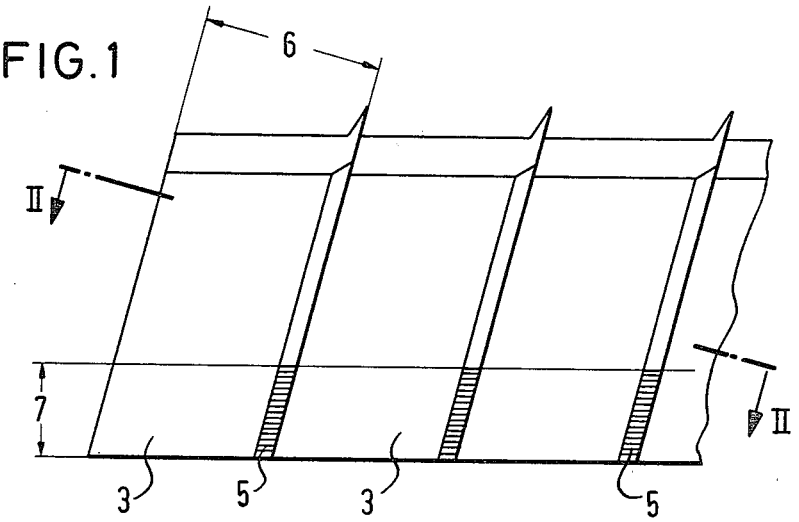
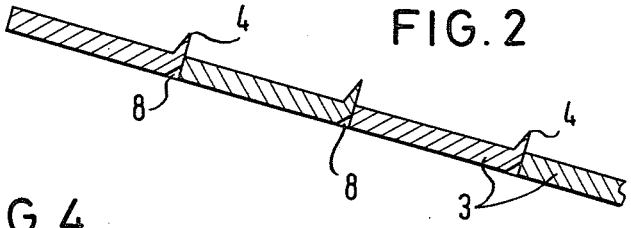
FIG. 2
FIG. 4
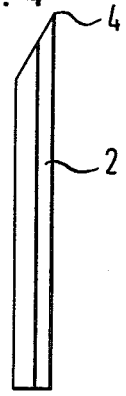
FIG. 3
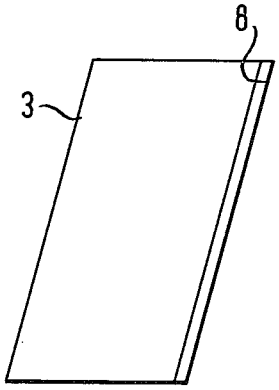
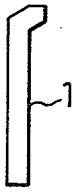
FIG. 5

CUTTER FOR WOOD CHIPPERS

BACKGROUND OF THE INVENTION

Cutters are known from German Published Patent Application No. 28 18 143 wherein the cutter blank is provided with scored lines at a spacing of one or several chip lengths, whereupon the material on each side of each scored line is bent out to form a rib.

Forming of the ribs is of substantial importance for the formation of the chip separators. With increasing forming depth, the cutting edge of the cutter decreases. Moreover, the shape and dimensions of the ribs and chip separators depends on the nature and quality of forming. Furthermore, stamping of the ribs causes unilateral deformation of the cutter, so that stresses and buildup develop which can be removed with great effort. Furthermore, decarburization in the edge zones and distortions by stress relief occurring during heat treatment can be controlled only by special devices and methods.

SUMMARY OF THE INVENTION

The object of the invention is a cutter having a cutting edge which is effective over the entire length of the cutter and in which the stresses relieved during heat treatment have no influence on the straightness of the cutting edge and decarburization can be easily removed during heat treatment.

Furthermore, it is an object of the invention to allow a rapid precise change of the cutter in the cutter holder removed from the cutter block and to reduce the wear of the necessary mounting screws.

According to the invention, therefore, profiles having essentially an L-shaped cross-section are produced in the form of long rods which are stamped into single pieces which are then hardened, ground, assembled in rows and joined to form a full-edged cutter.

After hardening, the individual profiles can be ground to one or several chip separator divisions, so that an exact separation within the assembled cutter is formed. This exact separation within the cutter guarantees a precise alignment of the separator tips within the cutter block in the chipper and thus a minimum of fines during the formation of wood chips.

Furthermore, it is possible for each individual profile piece to influence the width of the separator tip after hardening by grinding, then assembling several single profiles in a row and joining them subsequently.

Joining of the individual profiles into one cutter can be accomplished in various ways. The preferred type of joining consists of welding in that zone of the profiles which is required for cutting or for mounting the cutter with the cutter holder in the cutter block of the wood chipper. This welded joint can be formed before or after hardening. Furthermore, joining with a support in the form of a material strip is possible, which can be connected with the single profiles in a releasable or permanent, generally known manner. The cutter can be fabricated from conventional material. The cutter manufactured according to the invention can be used for straight as well as bevel-cutting blocks. The separating depth has no influence on the cutting edge. The separator depth and width are optional. Furthermore, the separator tips can be formed with an arbitrary shape and width. The long leg of the L of the cross-section forming the profile corresponds to the chip separation or length. Each profile can cover not only one but several chip separators.

In sum, the method of the invention therefore leads to the following specific advantages:

Contrary to the cutter according to German Patent Application No. 28 18 143, the cutter manufactured according to the invention cuts on its entire length. The chip separator depth of the cutter of the invention is independent of forming. All surfaces can be ground after hardening. This eliminates decarburization in the edge zones. The distance between the cutting edge of the cutter and the cutting edge of the separator tip is freely optional in the cutter of the invention, because no relationship exists between cutter thickness, cutting edge length and separator depth. The width of the separator cut is freely optional, i.e., the fines fraction can be influenced by the separator tip width. The separator profile can have any design. Broken cutting profiles can be replaced, so that further use of a cutter is possible in case of a partial fracture. No distortion due to hardening occurs, because no chip-free deformation takes place within the assembled cutter. Exact maintenance of chip separation is possible. This is particularly important in the production of "strand" chips, because this involves a minimum of fines in the chips. Finally, the risk of fracture is reduced in the cutter of the invention, because aging cracks can no longer form because of the chip-free forming method.

It should be pointed out that the exact division of the separator tips is also required when the solid-edge cutters are held in the cutter block without additional clamping, because the contact profile of the clamping holder must form a dust-free seal with the cutter to prevent contamination.

Furthermore, the invention affords continuous clamping of a chip cutter in a cutter holder, allowing a significantly more rapid change of cutters outside of the cutter block while the set cutter projection is maintained. The cutter holders can be mounted not only in conventional cutter blocks but also in ring chippers. Based on the considerably more rapid change of cutters, the downtimes of the wood chippers are considerably reduced.

DESCRIPTION OF THE DRAWING

The invention is described on the basis of the drawing attached as an example, where:

FIG. 1 shows a plan view of the cutter;

FIG. 2 is a section through the cutter along the dash-dot line of FIG. 1;

FIG. 3 is a plan view of a single profile after hardening and prior to joining;

FIG. 4 is a wide view of the cutter of FIG. 1;

FIG. 5 is a cross-section through a profile from which the single profiles are fabricated;

Figure 6:
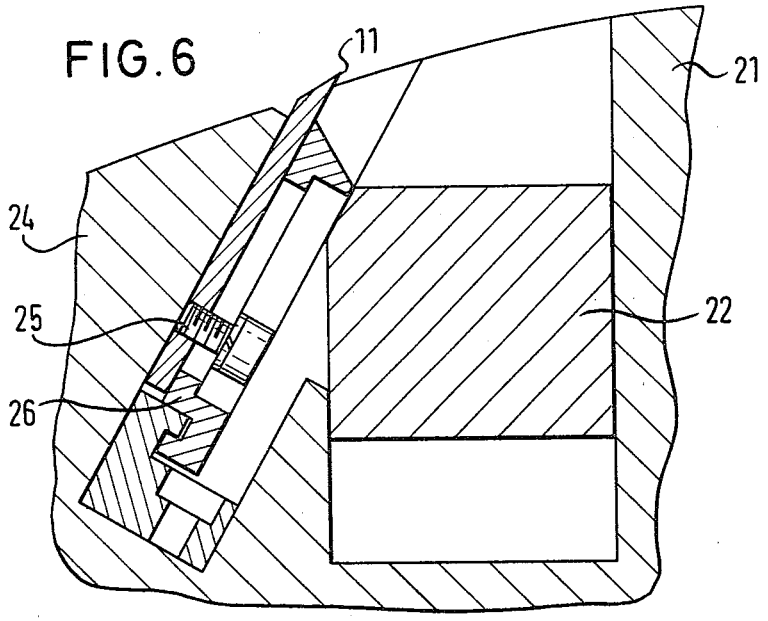
FIG. 6 is the conventional holder of a cutter.
Figure 7:
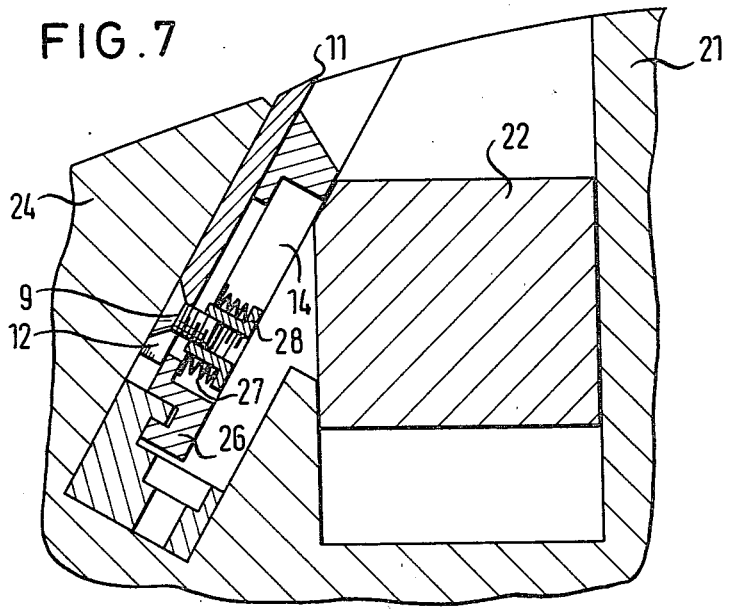
FIG. 7 is a holder system of the invention.

The cutter shown in FIGS. 1–5 is assembled from single profiles 3 which are joined by a welded seam 5 in welding groove 8. The welded seam 5 extends at least over the zone 7 provided for clamping the cutter in the cutter block.

Each profile 3 can have an L-shaped cross-section, where the short leg of the L which is formed into a tip, forms a rib 2 having a separator tip 4. The separator tip 4 falls into one plane with the rake of the cutter. In another practical example, the cross-section can have a U-shape.

The spacing of the separator tips 4 of the cutter, i.e., essentially the long leg of the L of the cross-section of each single profile 3, determines the chip separation, i.e., the chip length. It is evident that the cutting edge of the cutter extends from a separator tip 4 up to the next separator tip or to the end of the cutter, so that it is effective over the entire length of the cutter, i.e., a true full-edge cutter is involved.

The single profiles 3 are fabricated from a profile 1 which is advantageously beveled on its outer edge of its bend in order to form the welding groove 8 in the assembled cutter.

If FIGS. 6–10, 21 designates the part of a cutter block provided with peripheral recesses into which a cutter holder 6 can be inserted. The cutter holder, which is loaded by a shim wedge 22, carries the cutter, the cutting edge 11 of which projects by a defined distance from the surface of the cutter block 21. No. 24 is the cutter head.

In the known cutter holder according to FIG. 6, the connection between cutter holder 26 and the cutter is made via a screw 25 which sets in a threaded hole placed into the cutter. With each change of cutter, the cutter holder must be removed from the cutter block 21, after which the cutter block and cutter are disassembled by removing screw 25 and after changing the cutter, the cutter holder and the new cutter are assembled by reinserting the screw.

Figure 9:
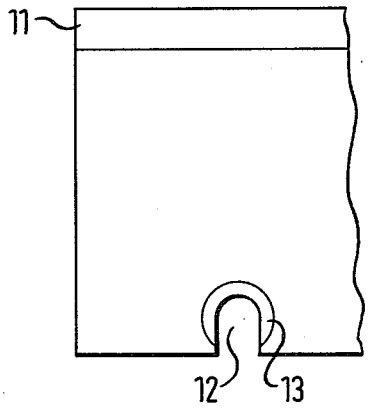
FIG. 9 is a side view of the cutter.
Figure 10:
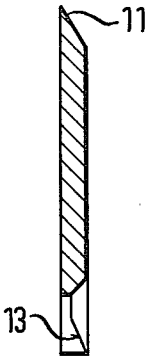
FIG. 10 is a section of the cutter.

According to the invention, the cutters, instead of having the threaded holes of the prior art, are now provided with slots 12 which are open on one side as shown in FIGS. 9 and 10. The opening of the slots 12 faces the underside of the cutter. A depression 13, which is either conical or cylindrical, is provided concentric to the closed slot end. With a conical depression 13, mounting of the cutter in two planes is possible.

In the previous slots 14 of the cutter holder 26, spring elements 27 are inserted, which may be plate springs, for example. A guide sleeve 28 is provided within the plate spring 27 and has an internal thread into which a clamping part 9 is screwed. This clamping part 9 can have a truncated cone or cylindrical shape, depending on the design of depression 13 in the slot 12.

The clamping part is adjusted to the pretensioning force and is secured with a lock screw, not shown here, so that the clamping part will not shift during the release and locking function.

Figure 8:
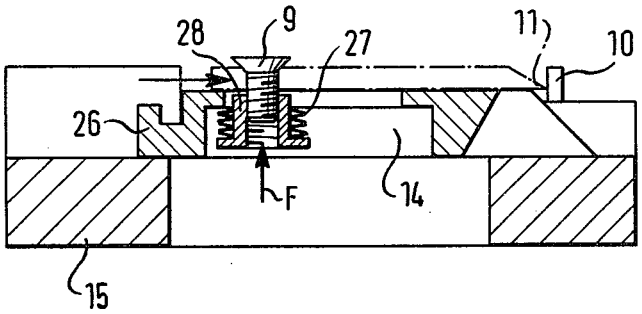
FIG. 8 is an auxiliary device for changing cutters.

For mounting the cutters in the cutter holder with a precise alignment, the holder with the spring elements is placed into a device 15 as shown in FIG. 8. Now pressure in the direction of arrow F is exerted on the zone of the spring elements perpendicular to the cutter holder 26, so that the spring elements 27 are compressed and the clamping part 9 extrudes from the depressed end 13 of the slot 12 in the cutter. This releases the cutter and allows its removal. A sharpened cutter is now inserted and pushed with spring elements 27 against a stop 10, and after the cutter edge 11 contacts stop 10, the pressure on the spring elements decays. The clamping part 9 now descends in centered fashion into depression 13 of slot 12 and clamps the cutter firmly on the cutter holder 26, so that the cutter is aligned, after which the cutter holder can be inserted in the cutter block 21.

In place of the spring-loaded clamping part 9, it is also possible to use a screw, while retaining the advantage of a rapid change of cutters with a precise alignment. It is no longer necessary to remove and reinsert the screw completely during a change of cutters. Loosening of the screw to the point that the screw head moves out of the depression 13 suffices for removal of the cutter.

The cutter holder together with the cutters provided with slots, which can be throwaway or regindable cutters, can be inserted in all known wood chippers without need for modifying the cutter block or the shim wedge. Therefore, the advantage of considerable time saving during cutter changes is also realized in addition to maintaining an exact projection of the cutter when it is reinstalled in the cutter block.

What is claimed is:

1. A cutter for wood chippers on which the chip separation surface formed with chip separator tips for chip separation, characterized by a plurality of connected single profile pieces of essentially L-shaped cross-section their short legs forming a rib and their long legs forming cutting edges of the cutter, the base of said cutter being provided with slots which aee open on one side, and a central depression in in said slot for receipt of a releasable clamping device for affixing the cutter to a holder.

2. A cutter according to claim 1 in which the depression has the shape of a truncated cone.

3. A cutter according to claim 1 in which the depression is cylindrical.

4. A cutter according to claim 1, wherein the clamping device consists of at least one spring element, an axially arranged guide sleeve with an internal thread and a clamping element screwed into the thread and biased by said spring element into engagement with the depression of the cutter.

5. A cutter according to claim 4 further including a lock screw for affixing said sleeve and said clamping element against relative rotation.

6. A cutter according to claim 1, wherein the clamping device consists of a screw having a portion complimentary to the cutter depression.

* * * * *